US011045678B1

(12) United States Patent
Dattner

(10) Patent No.: US 11,045,678 B1
(45) Date of Patent: Jun. 29, 2021

(54) SYSTEMS AND METHODS FOR MODULAR RECREATIONAL STRUCTURES

(71) Applicant: Richard Dattner, New York, NY (US)

(72) Inventor: Richard Dattner, New York, NY (US)

( * ) Notice: Subject to any disclaimer, the term of this patent is extended or adjusted under 35 U.S.C. 154(b) by 0 days.

(21) Appl. No.: 17/112,781

(22) Filed: Dec. 4, 2020

(51) Int. Cl.
*A63B 9/00* (2006.01)

(52) U.S. Cl.
CPC ..... *A63B 9/00* (2013.01); *A63B 2009/006* (2013.01); *A63B 2210/50* (2013.01)

(58) Field of Classification Search
CPC .. A63B 9/00; A63B 2009/006; A63B 2210/50
See application file for complete search history.

(56) References Cited

U.S. PATENT DOCUMENTS 3,618,273 A * 11/1971 Crandall ..... E04B 1/34807 52/79.4
3,814,416 A * 6/1974 Munger ..... A63B 9/00 482/36
3,970,301 A * 7/1976 Lehmann ..... A63B 9/00 482/35
4,060,247 A * 11/1977 Kobres, Jr. ..... A63F 9/1288 273/157 R
4,097,043 A * 6/1978 Rudy ..... A63B 9/00 403/172
4,478,418 A * 10/1984 Sherman, Jr. ..... A63F 9/0834 273/153 S
4,482,900 A * 11/1984 Bilek ..... H01Q 15/161 343/915
4,557,484 A * 12/1985 Sherman, Jr. ..... A63F 9/0834 273/153 S
4,686,800 A * 8/1987 McCormick ..... E04B 1/3211 29/469
4,905,443 A * 3/1990 Sutcliffe ..... E04B 1/1906 52/655.2
5,168,677 A * 12/1992 Pronsato ..... A63F 9/1208 52/81.1
5,184,789 A * 2/1993 Aldrin ..... B64G 1/12 244/159.4
5,201,160 A * 4/1993 Sanchez ..... E04B 1/19 52/645
5,259,710 A * 11/1993 Charles ..... B23Q 1/015 408/234
5,303,695 A * 4/1994 Shopsowitz ..... A63B 5/00 124/17

(Continued)

*Primary Examiner* — Garrett K Atkinson
(74) *Attorney, Agent, or Firm* — Hodgson Russ LLP

(57) ABSTRACT

A cuboctahedron-based recreational structure may comprise a plurality of hubs and a plurality of tubes. A kit for assembling the same may comprise a plurality of hubs and optionally a plurality of tubes. The plurality of hubs may include tetrapod hubs, hexapod hubs, and/or octopod hubs, each being configured to receive tubes extending from different ones of the plurality of hubs to form one or more cuboctahedral frames. Each hub may comprise a plurality of tube receptacles. The plurality of hubs and the plurality of tubes may be arranged to form one or more cuboctahedral frames, each having twenty-four edges and twelve vertices. Edges of the one or more cuboctahedral frames may comprise tubes. Vertices of the one or more cuboctahedral frames may comprise hubs. Connections between the hubs and the tubes may be formed by an end portion of each tube disposed within a tube receptacle of a hub.

22 Claims, 10 Drawing Sheets

(56) References Cited

U.S. PATENT DOCUMENTS 5,405,304 A * 4/1995 Petersheim ..... A63B 9/00 434/258
5,448,868 A * 9/1995 Lalvani ..... E04B 1/3211 52/648.1
5,562,552 A * 10/1996 Thurman ..... A63B 37/0004 473/379
5,704,169 A * 1/1998 Richter ..... E04B 7/105 52/81.2
6,561,931 B1 * 5/2003 Reeves ..... A63B 63/004 403/102
6,905,426 B2 * 6/2005 Morgan ..... A63B 37/0004 473/383
6,931,812 B1 * 8/2005 Lipscomb ..... E04B 1/19 52/648.1
6,942,487 B2 * 9/2005 Corbalis ..... A63B 69/0093 280/818
7,060,002 B1 * 6/2006 Boehme ..... A63B 9/00 482/35
7,309,298 B2 * 12/2007 Morgan ..... A63B 37/0004 473/383
7,694,465 B2 * 4/2010 Pryor ..... E04C 3/28 52/108
7,951,047 B2 * 5/2011 Kohler ..... A63B 9/00 482/23
7,971,831 B2 * 7/2011 Roseman ..... B64G 1/222 244/159.6
8,047,473 B2 * 11/2011 Johnson ..... B64G 9/00 244/159.4
8,100,814 B2 * 1/2012 Van Raalte ..... A63B 69/0048 482/35
8,257,088 B1 * 9/2012 Askins ..... A63B 21/0414 434/247
8,430,930 B2 * 4/2013 Hunt ..... A61B 17/1604 623/17.11
9,056,232 B2 * 6/2015 Rigoli ..... A63B 63/004
D807,435 S * 1/2018 Dykes ..... D21/337
10,413,791 B2 * 9/2019 Moore ..... F16B 7/1481
10,443,233 B2 * 10/2019 von Gonten ..... G05D 19/02
10,603,547 B2 * 3/2020 Hsu ..... A63B 26/00
2003/0158002 A1 * 8/2003 Morgan ..... A63B 37/0021 473/383
2005/0266934 A1 * 12/2005 Morgan ..... A63B 37/0009 473/383
2009/0286656 A1 * 11/2009 Okamoto ..... A63B 19/04 482/78
2011/0306438 A1 * 12/2011 Moore ..... A63B 53/007 473/296
2017/0032063 A1 * 2/2017 Li ..... G06F 17/10
2017/0242936 A9 * 8/2017 Li ..... G06F 30/20
2019/0032331 A1 * 1/2019 von Gonten ..... E04H 9/0215

* cited by examiner

Tetrapod Joint

Hexapod Joint

Octopod Joint

SYSTEMS AND METHODS FOR MODULAR RECREATIONAL STRUCTURES

FIELD OF THE INVENTION

The disclosure generally relates to recreational equipment.

BACKGROUND OF THE INVENTION

Recreational facilities often include assembled structures, such as jungle gyms, slides, and mazes. Commonly, each recreational structure is assembled from a plurality of components, some of which are unique to a particular structure. Assembly can be a complex procedure, and assembly mistakes are common. In addition, there is little or no opportunity for the end-user and/or assembler to vary the form or design of the structure because the various components must be integrated in a preset manner in order to provide a stable structure.

Currently, play areas often are created on or in spaces (e.g. an empty parcel of land, a backyard, or a shared space) having an irregular shape, in terms of both boundaries and topography, and/or features that are not uniform between different play spaces. For example, recreational areas known as "pocket parks" and the desire for more recreational areas within limited city areas, such as on designated play streets, are driving demand for recreational structures that can be modified easily to accommodate non-uniform play areas. Moreover, some modern play areas are temporary (e.g. seasonal), and so there is a desire for recreational structures that can be rapidly assembled and disassembled. However, the problems associated with assembly and disassembly of existing recreational structures, as well as their predefined size make existing recreational structures poor choices for many modern play spaces.

SUMMARY OF THE INVENTION

Embodiments disclosed herein comprise unique, segmented hubs capable of joining standard metal tubing to create recreational structures comprising one or more cuboctahedral frames.

The invention may be embodied as a kit for assembling one or more modular cuboctahedron-based recreational structures. The kit may comprise a plurality of hubs. Each hub may be configured to receive a plurality of tubes extending from different ones of the plurality of hubs to form one or more cuboctahedral frames. The plurality of hubs may include a tetrapod hub, a hexapod hub, and/or an octopod hub. The tetrapod hub may have four tube receptacles, and the tetrapod hub may be configured to form a vertex of one of the cuboctahedral frames. The hexapod hub may have six tube receptacles, and the hexapod hub may be configured to form a vertex of up to two cuboctahedral frames. Alternatively, the hexapod hub may have eight tube receptacles, wherein six of the tube receptacles are configured to receive one of the tubes and two of the eight tube receptacles are configured to receive a plug. The octopod hub may have eight tube receptacles, and the octopod hub may be configured to form a vertex of up to four cuboctahedral frames. The hexapod hub may be similar to the octopod hub. Each tube receptacle may be configured to mate with one of the tubes, and each tube may be configured to mate with a tube receptacle of another hub of the plurality of hubs. The tubes may comprise metal, plastic, composite material, or carbon fiber.

Each tube receptacle may comprise a first mating surface configured to mate with a second mating surface of one of the tubes. The first mating surface and second mating surface may be configured to maintain the relative positions of the tube and the tube receptacle. One of the first and second mating surfaces may have a depression, and the other of the first and second mating surfaces may have a protrusion. The protrusion may be complementary to the depression.

Each hub may comprise a plurality of hub components. The kit may further comprise a fastener configured to fasten two or more of the hub components to each other. Each hub may be aluminum, steel, plastic, or carbon fiber composite. At least one of the hubs may have a rounded apex.

The kit may further include a stepping platform, which may be configured to be attached to two or more tubes of the plurality of tubes.

The invention may be embodied as a climbable recreational structure comprising one or more cuboctahedral frame assemblies. Each cuboctahedral frame assembly may include six square spaces, eight triangular spaces, and twelve vertices. The structure may be assembled from a plurality of hubs, which may comprise tetrapod hubs connecting four tubes, hexapod hubs connecting six tubes, and/or octopod hubs connecting eight tubes. The climbable recreational structure may further include a stepping platform, which may be configured to be attached to two or more tubes of an assembled cuboctahedral frame.

The invention may be embodied as a recreational structure comprising a plurality of hubs and a plurality of tubes. Each hub may comprise a plurality of tube receptacles. The plurality of hubs and the plurality of tubes may be arranged to form one or more cuboctahedral frames. Each cuboctahedral frame may have twelve vertices and twenty-four edges. The edges of the one or more cuboctahedral frames may each comprise one of the plurality of tubes. The vertices of the one or more cuboctahedral frames may comprise one of the plurality of hubs. Connections between the hubs and the tubes may be formed by an end portion of each tube disposed (e.g., inserted, placed, fitting) within a tube receptacle of a hub.

The plurality of hubs may include one or more of a tetrapod hub, a hexapod hub, and/or an octopod hub. The tetrapod hub may have four tube receptacles, and each may be configured to receive one of the tubes. The tetrapod hub may be configured to form a vertex of one of the cuboctahedral frames. The hexapod hub may have six tube receptacles, and each may be configured to receive one of the tubes. Alternatively, the hexapod hub may have eight tube receptacles, wherein six of the tube receptacles are configured to receive one of the tubes and two of the eight tube receptacles are configured to receive a plug. The hexapod hub may be configured to form a vertex of one or more of the cuboctahedral frames. The octopod hub may have eight tube receptacles, and each may be configured to receive one of the tubes. The octopod hub may be configured to form a vertex of one or more of the cuboctahedral frames. The hexapod hub may be similar to the octopod hub.

Each hub may comprise a plurality of hub components. The recreational structure may further comprise a fastener configured to fasten two or more of the hub components to each other. Each hub component may include a depression configured to receive a protrusion of another hub component or a protrusion configured to fit into a depression of another hub component. The hubs may comprise cast aluminum, steel, high strength plastic, or carbon fiber composite. At least one of the hubs may have a rounded apex.

The recreational structure may further include a stepping platform, which may be attached to two or more tubes of the plurality of tubes.

Additional features and advantages of the present invention are described further below. This summary section is meant merely to illustrate certain features and embodiments of the invention and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION OF THE INVENTION

Figure 1A:
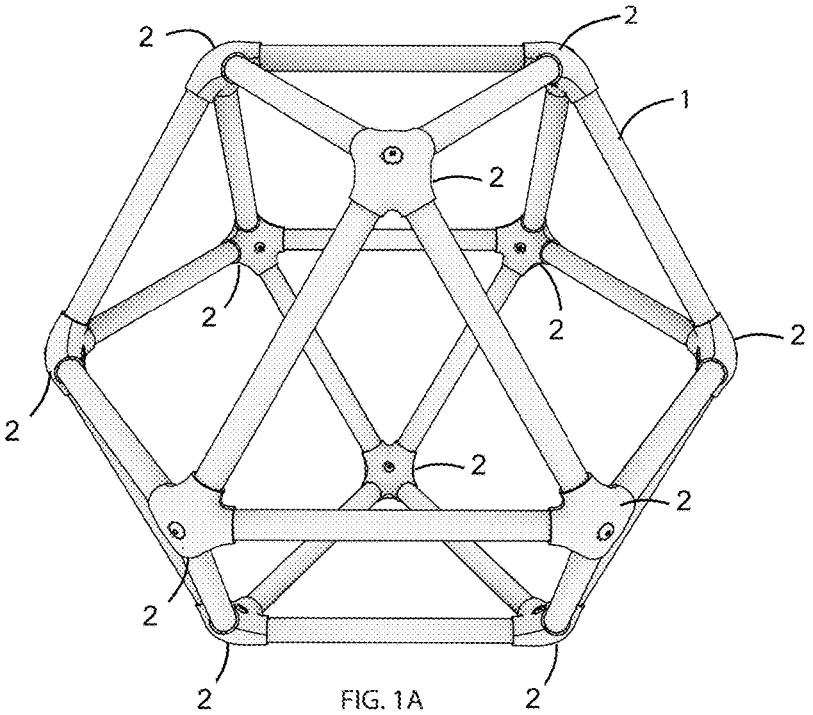
FIG. 1A is a perspective view of an illustrative cuboctahedron-based recreational structure according to various embodiments of the invention.

Although claimed subject matter will be described in terms of certain embodiments, other embodiments, including embodiments that do not provide all the benefits and features set forth herein, are also within the scope of this disclosure. Various structural, logical, process step, and electronic changes may be made without departing from the scope of the disclosure. Accordingly, the scope of the disclosure is defined only by reference to the appended claims.

Certain recreational structures and designs for providing personalized recreational facilities exist in the art. For example, the present inventor's earlier U.S. Pat. Nos. 3,632,109, D218,459, and D218,460, each of which is incorporated by reference herein in its entirety, describe recreational structures and designs.

Additionally, U.S. Patents illustrating specialized joints in recreational structures include U.S. Pat. Nos. 7,677,010, 6,722,086, 4,097,043, 4,069,832, and 10,443,233. However, these structures require relatively large shipping and storage volumes, even when provided in two-shell halves, as disclosed in U.S. Pat. No. 3,949,985.

Certain improvements have been made, for example, as shown in the present inventor's U.S. Pat. No. D835,223, the description of which is incorporated by reference herein. This structure can be fabricated from perforated steel panels having circular openings allowing play to occur through and over the structure. However, because each structure is designed to be bolted to adjoining structures at one or more of their six square sides, each joining requires two identical sides even though such duplicate sides are not required for structural strength or rigidity. Thus, the prior art design results in wasted material, additional weight, more complex manufacturing, and additional cost.

The present invention overcomes the above-described deficiencies and provides, in various embodiments, a cuboctahedron-based climbable recreational structure that can be constructed using standard metal tubing and a plurality of hubs to form one or more cuboctahedral frames. Hubs may include tetrapod hubs, hexapod hubs, and octopod hubs. Tetrapod hubs may provide four tube receptacles. Hexapod hubs may provide six tube receptacles. Octopod hubs may provide eight tube receptacles. An octopod hub and hexapod hub may share a similar design, with the hexapod hub having the same hub components as the octopod hub, but including plugs disposed in two of the tube receptacles instead of tubes as would be the case for an octopod hub. Further, if when assembled a hub is used having more tube receptacles than necessary to connect the number of tubes to be received, for example, if an octopod hub is used to join six tubes thereby providing two available tube receptacles for attaching other features to the recreational structure instead of plugs, for example, playground features (e.g., a slide, a flagpole, a ladder, or other playground element).

Herein, embodiments of the invention may be described as comprising one or more cuboctahedral frames resembling cuboctahedrons. In geometry, a cuboctahedron is a three-dimensional shape having twenty-four edges and twelve vertices, arranged such that the cuboctahedron has eight triangular faces and six square faces, making fourteen faces (i.e., sides). In a recreational structure according to the invention having at least one cuboctahedral frame resembling a cuboctahedron, each of the cuboctahedral frame's 24 edges roughly coincide with a tube, and each of the cuboctahedral frame's twelve vertices roughly coincide with a hub.

In geometry, a cuboctahedron's vertices are identical, with four edges meeting at each vertex, such that each vertex of the cuboctahedron is also a vertex of two triangular faces and two square faces; two edges meeting at a single vertex share an angle of either 60 degrees or 90 degrees in the plane in which their longitudinal axes are coplanar. Such faces refer to the areas (e.g., empty portions) bounded by any three edges that bound an equilateral triangular face or any four edges that bound a square face. In this disclosure, a reference to a recreational structure comprising a cuboctahedral frame resembling a cuboctahedron may refer to a geometric polyhedron in which the vertices are represented by the hubs, and the edges are represented by tubes. Rather than faces, the recreational structure's cuboctahedral frames have open spaces through which a user might climb or extend an arm or leg. In other words, recreational structures embodied herein may comprise tubes and hubs arranged to form cuboctahedral frames, which individually resemble cuboctahedrons.

The hubs may be formed from hub components, such that the hub components may be joined together to comprise a given hub. For example, a tetrapod hub may comprise two hub components, which, when mated together, form the tetrapod hub and secure up to four tubes in the tube receptacles thereof. The tetrapod hub may have an apex proximate a vertex shared by the reflex angles formed by longitudinal axes of any two tube receptacles. The hexapod hub or octopod hub may have apexes proximate a vertex shared by the reflex angles of any two tube receptacles Such apexes may be rounded. The hub components may each be shaped such that there is an interlocking feature, for example, a protrusion on one hub component and a corresponding depression on another. Such interlocking features may assist in aligning the hub components and/or holding them together during assembly of a cuboctahedral frame as a protrusion on one hub component may be fitted into a depression on another hub component. The hub components may be secured together by a fastener, such as, for example, a bolt. Such a fastener may be a tamper-resistant fastener to prevent its removal or loosening and thereby preserve the integrity and safety of the recreational structure.

The hubs are preferably shaped to ensure accurate locking and structural rigidity.

Hexapod hubs and octopod hubs may also be fashioned from hub components. For example, hexapod hubs and octopod hubs may be each formed from a set of four hub components, the set of four hub components comprising two pairs of identical hub components. The hub components used to form hexapod hubs and octopod hubs may include interlocking features like those included by tetrapod hubs. Such interlocking features may assist with aligning the hubs and/or holding them together during assembly. The hub components used to form a hexapod hub may be the same components used to form an octopod hub. For example, four hub components may be joined together to compose a hexapod hub or an octopod hub. When the resulting hub is used as a hexapod hub, two of the eight tube receptacles may each receive a plug or other playground feature, but when used to form an octopod hub, the same tube receptacles may each receive a tube.

A recreational structure comprising one cuboctahedral frame can be assembled from twelve tetrapod hubs and twenty-four tubes. The tubes may be identical to each other, and/or the hubs may be identical to each other.

If two cuboctahedral frames are joined at facing square spaces to form a recreational structure, hexapod hubs can create the required hubs without duplicating adjoining spaces. That is to say, two adjoining cuboctahedral frames may share at least one hub, and may further share at least one edge. Where three or four cuboctahedral frames are joined at facing square spaces, octopod hubs may be used to create the required hubs without duplicating adjoining spaces. No more than four cuboctahedral frames can meet at one hub regardless of how many cuboctahedral frames are assembled to form the recreational structure.

The components of the tetrapod hubs, hexapod hubs, and octopod hubs as well as the tubes may be mass-produced from a variety of materials (for example, metals such as steel or cast aluminum, plastics such as high strength plastic, composites such as carbon-fiber composites). Furthermore, computer-controlled three-dimensional prototyping may be used to determine the specific geometry of the hubs and tubes based on various rules, guidance, or design principles. Such three-dimensional prototyping may be used to determine the quantity of the various types of hubs and tubes to include in a kit based on, for example, desired recreational structure geometry or size requirements.

Other advantages of the invention may include, for example: easy shipping of the modular hubs and tubing for assembly on site; less volume may be required for shipping and storing of the modular components; the ability to replace one or more damaged components without requiring replacement of an entire cuboctahedral frame; and/or increased structural strength and rigidity due to the ability of these components to vary in thickness according to encountered stresses.

Another advantage of embodiments may be a reduction in cost, since such embodiments provide for the ability to use standard tubing. Standard tubing is available in various diameters, materials (e.g., metals, plastics, composites), and wall thicknesses to meet structural requirements.

Another advantage afforded by at least some embodiments of the invention may be an ability to increase or decrease the size of the components, thereby allowing recreational structures of varying sizes, which may result in accommodating different age groups with structures having similar geometries. The hubs can accommodate tubing of varying lengths and can be adapted to accommodate tubing of varying diameters.

Figure 1B:
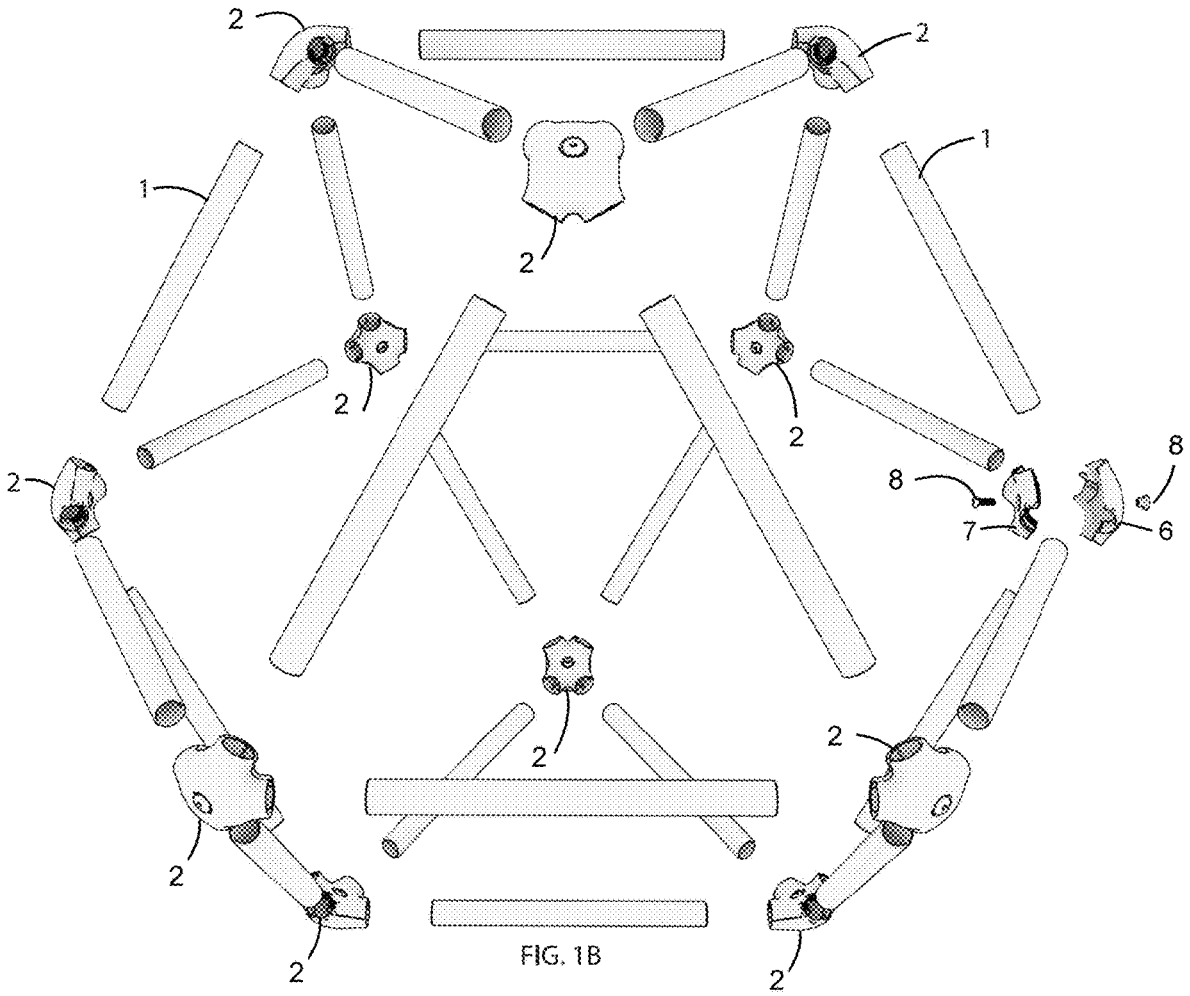
FIG. 1B is an exploded view of the cuboctahedron-based recreational structure of FIG. 1A.
Figure 17:
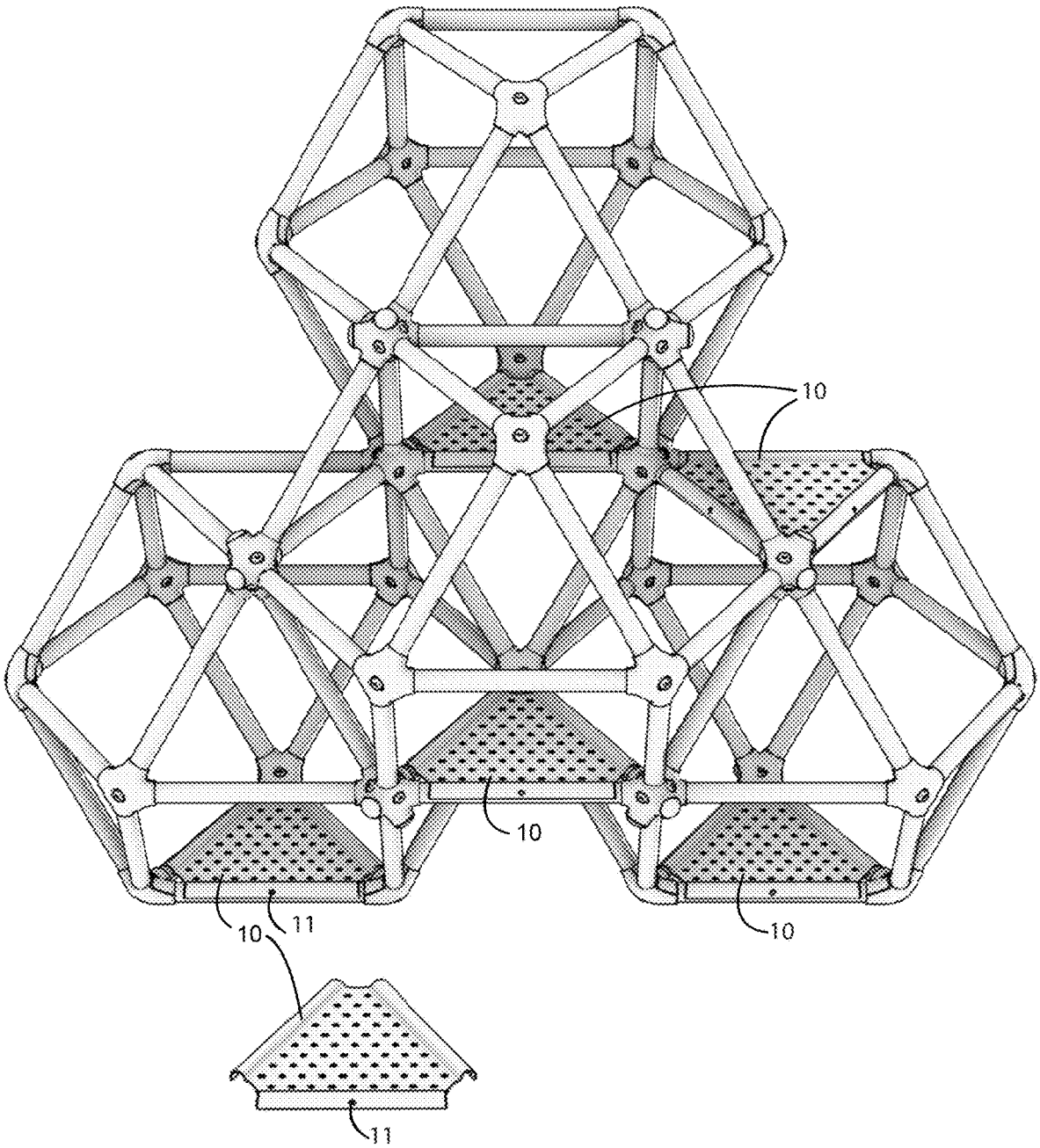
FIG. 17 is a perspective view of the recreational structure of FIG. 16 including illustrative stepping platforms according to various embodiments of the invention.

FIGS. 1A and 1B are perspective views of an example recreational structure comprising a cuboctahedral frame having twenty-four tubes 1, which may be metal tubes, and twelve tetrapod hubs 2. FIG. 1A shows the recreational structure assembled, and FIG. 1B shows the components of the recreational structure. Each end of each metal tube may be fastened to a different tetrapod hub by inserting the metal tube end into a tube receptacle of the tetrapod hub. By varying the length of the tubes, the size of the cuboctahedral frame may be modified, and thereby accommodate play by individuals of different age groups. Square or triangular platforms 10 can be attached to the tubes that are used to create the recreational structures, as depicted in FIG. 17, thereby providing platforms on which an individual may stand.

Figure 2:
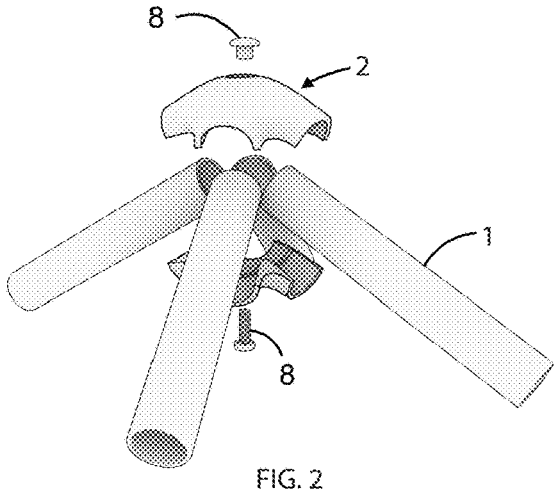
FIG. 2 is a perspective view of an illustrative tetrapod hub according to various embodiments of the invention.
Figure 3:
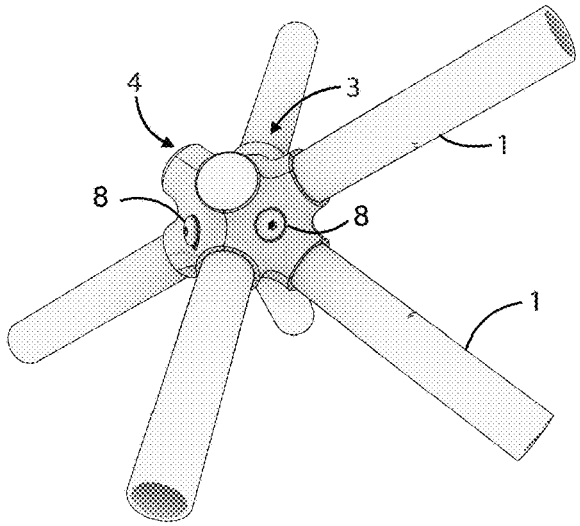
FIG. 3 is a perspective view of an illustrative hexapod hub according to various embodiments of the invention.
Figure 4:
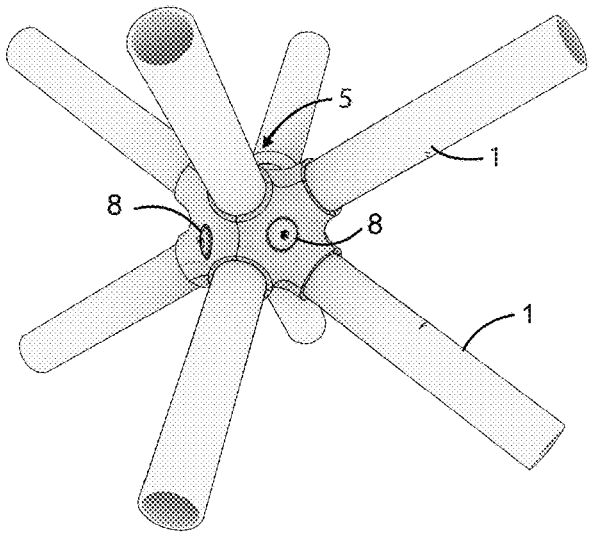
FIG. 4 is a perspective view of an illustrative octopod hub according to various embodiments of the invention.

FIGS. 2, 3, and 4 are perspective views of illustrative joining components for creating recreational structures comprising one or more cuboctahedral frames. Joining surfaces according to various embodiments of the invention are visible in these views. FIG. 2 shows an illustrative tetrapod hub 2 having four tubes (i.e., arms) extending therefrom, each hub 2 being configured to receive a tube 1. FIG. 3 shows an illustrative hexapod hub 3 having six tubes extending therefrom. The hexapod hub 3 may have tube receptacles configured to receive tubes, six of which are shown receiving a different tube 1 and two of which are shown receiving a plug 4. The plugs 4 may have a rounded outwardly facing surface. Plugs 4 may be shaped to have a minimal profile extending longitudinally past the tube receptacle, and further may be designed to minimize safety concerns. FIG. 4 shows an illustrative octopod hub 5 having eight tubes extending therefrom. It will be noticed from FIGS. 3 and 4 that the octopod hub 5 and the hexapod hub 3 may be similar, the difference being the number of tubes 1 extending therefrom.

Figure 5:
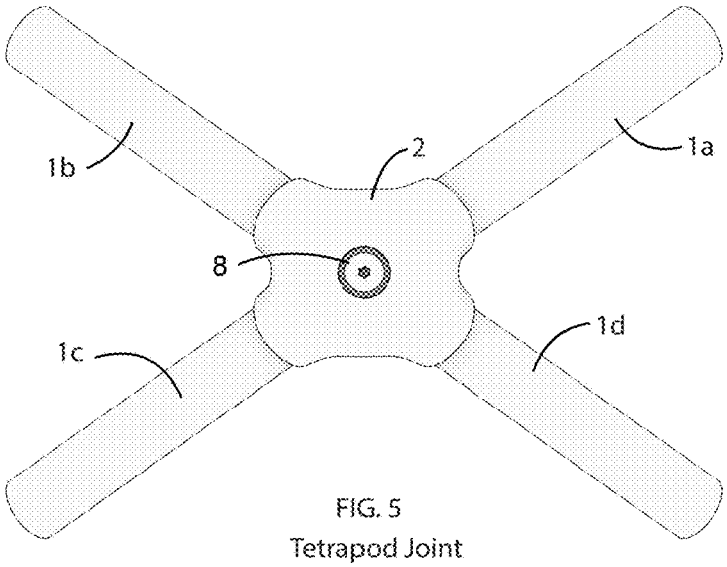
FIG. 5 is a top view of the tetrapod hub of FIG. 2.
Figure 6:
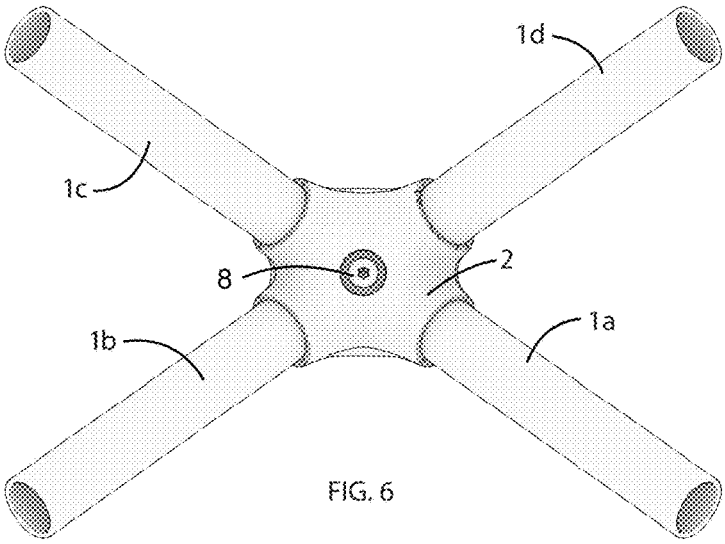
FIG. 6 is a bottom view of the tetrapod hub of FIG. 2.
Figure 7:
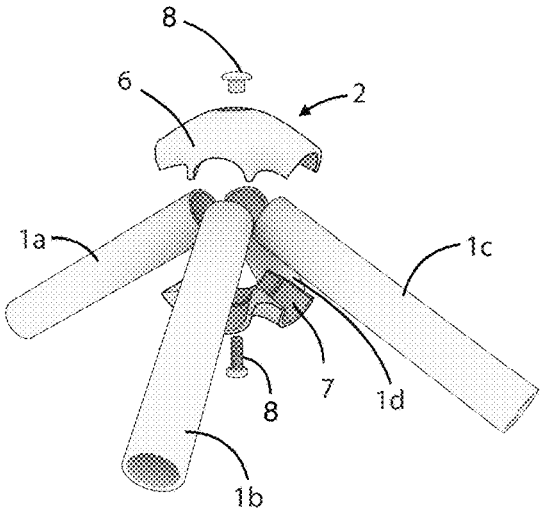
FIG. 7 is a perspective view of the tetrapod hub of FIG. 2.

FIGS. 5, 6, and 7 are top, bottom, and perspective views, respectively, of an illustrative tetrapod hub 2 joining four tubes a, 1*b*, 1*c*, and 1*d* extending therefrom. FIG. 5 is a top view of a tetrapod hub 2 showing a first hub component 6 thereof having a round convex upper surface joining four tubes 1*a*, 1*b*, 1*c*, and 1*d* extending from the tetrapod hub 2. FIG. 6 is a bottom view of the tetrapod hub 2 showing a second hub component 7 thereof having a concave lower surface joining four tubes 1*a*, 1*b*, 1*c*, and 1*d* extending from the tetrapod hub 2. FIG. 7 is an exploded perspective view of a tetrapod hub 2 showing separately first hub component 6, second hub component 7, and four tubes 1. Tetrapod hubs 2 may be used to join four tubes of a cuboctahedral frame where the hub need not be shared with another cuboctahedral frame or other playground component.

Figure 7A:
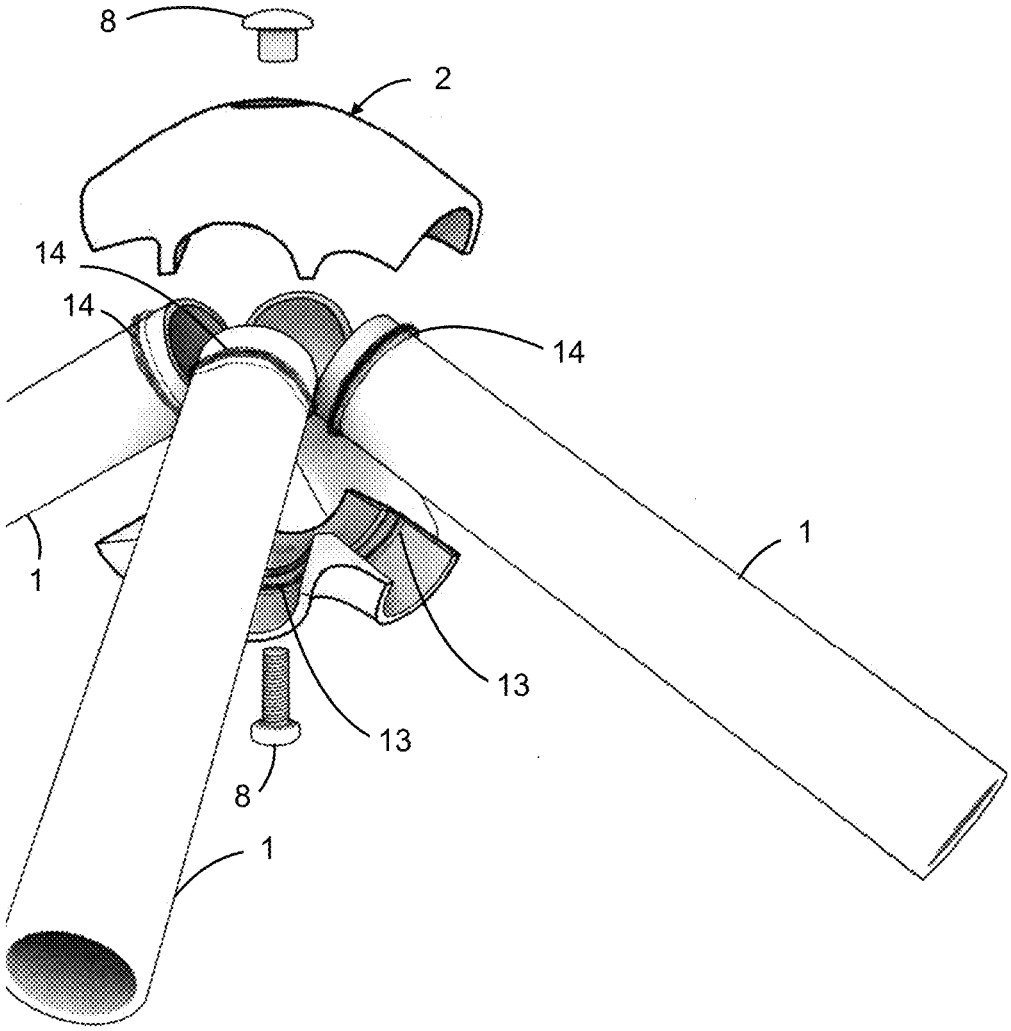
FIG. 7A is a perspective view of a portion of a tetrapod hub similar to the tetrapod hub of FIG. 2 depicting a depression of the tetrapod hub and corresponding protrusion of the tube.

In some embodiments of the invention, as depicted in FIG. 7A, each tube receptacle may include in a first mating surface 13 configured to mate with a corresponding second mating surface 14 on its corresponding tube 1 in order to align, secure, and/or lock the tube in place and create a recreational structure comprising one or multiple cuboctahedral frames. Such aligning, securing, and/or locking may be achieved by the first mating surface 13 and the second mating surface 14 corresponding to each other such that one fits within the other. In some embodiments, first mating surface 13 may include a depression and second mating surface 14 may include a protrusion. Alternatively, first mating surface 13 may include a protrusion and second mating surface 14 may include a depression. A given protrusion on one of the tubes or tube receptacles, as the case may be, may have a corresponding depression on the other of the tube receptacle or tube such that the protrusion fits into the depression. In this way, the depression and protrusion that have been mated may be considered complementary to each other. Such a depression or protrusion may be formed in a variety of ways including, for example, by crimping a portion of the tube or tube receptacle, or providing for it in a mold used to cast the tube or the hub, or using a machining tool such as a punch or lathe. Such depressions may be configured as, for example, a channel, slot, dimple, or recessed section of a tube or tube receptacle. Such protrusions may be configured as, for example, a nib, bump, circumferential ridge, flared end, or other protruding section of a tube or tube receptacle. Such a protrusion may be configured to fit within a corresponding depression of the other of the tube or tube receptacle, which may take the form of, for example, a circumferential channel, which may be formed into an outer surface of the tube or an inner surface of the tube receptacle. Such protrusions and/or depressions may have corresponding cross-sections, for example, circular, rectangular, square, triangular, or irregular cross-sections, and may align with the tube's and tube receptacle's longitudinal axes or circumferences.

Figure 8:
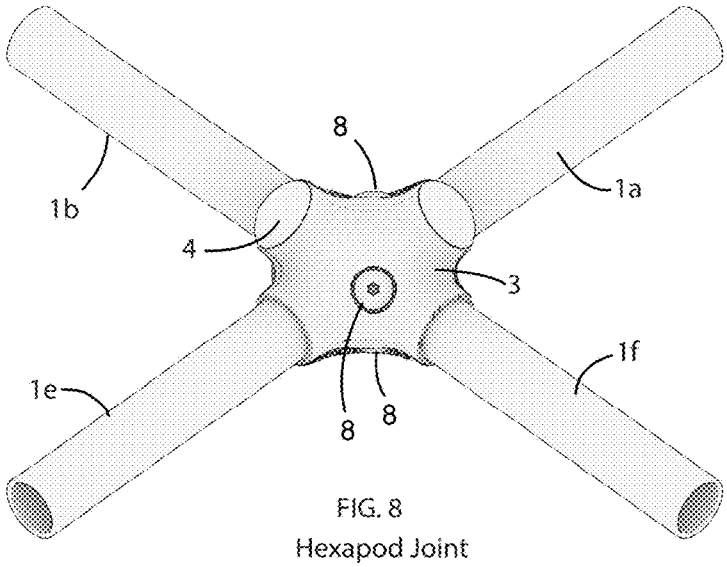
FIG. 8 is a top view of the hexapod hub of FIG. 3.
Figure 9:
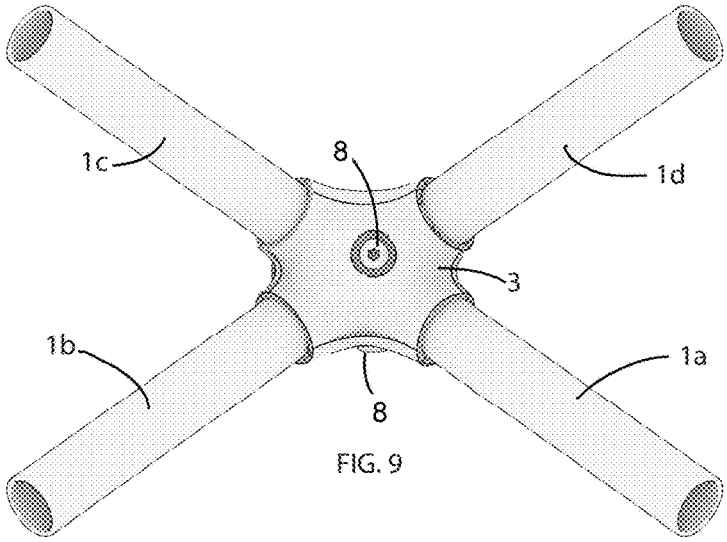
FIG. 9 is a bottom view of the hexapod hub of FIG. 3.
Figure 10:
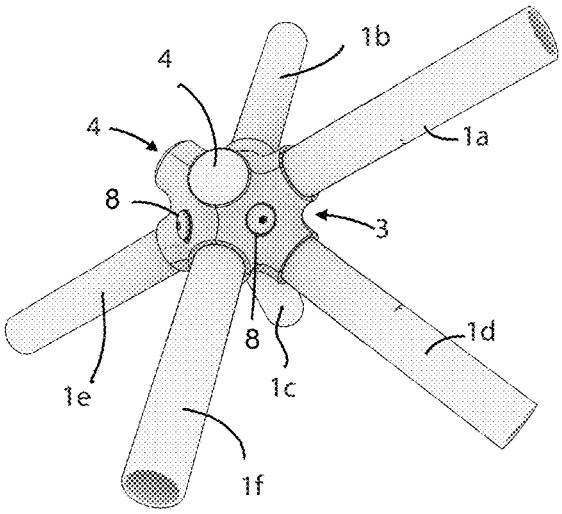
FIG. 10 is a perspective view of the hexapod hub of FIG. 3.

FIGS. 8, 9, and 10 are top, bottom, and perspective views of an illustrative hexapod hub with eight tube receptacles, six of which have a different tube 1 extending therefrom and two of which have plugs 4. FIG. 8 is a top view showing the hexapod hub 3 and four tubes 1*a*, 1*b*, 1*e*, and 1*f* of six tubes extending therefrom. FIG. 9 is a bottom view that shows the hexapod hub 3 and four tubes 1*a*, 1*b*, 1*c*, and 1*d* of the six tubes extending therefrom. FIG. 10 is a perspective view showing the hexapod hub 3, the six tubes 1*a*, 1*b*, 1*c*, 1*d*, 1*e*, and 1*f* extending therefrom, and one of the two plugs 4. Hexapod hubs 3 may be used to provide hubs common to two adjacent cuboctahedral frames, thus avoiding duplication of material between cuboctahedral frames. The hub components of a hexapod hub 3 may be manufactured as modular sections, thereby simplifying production. The constituent hub components of a hexapod hub 3 and an octopod hub 5 may be identical, further simplifying production and erection.

Figure 11:
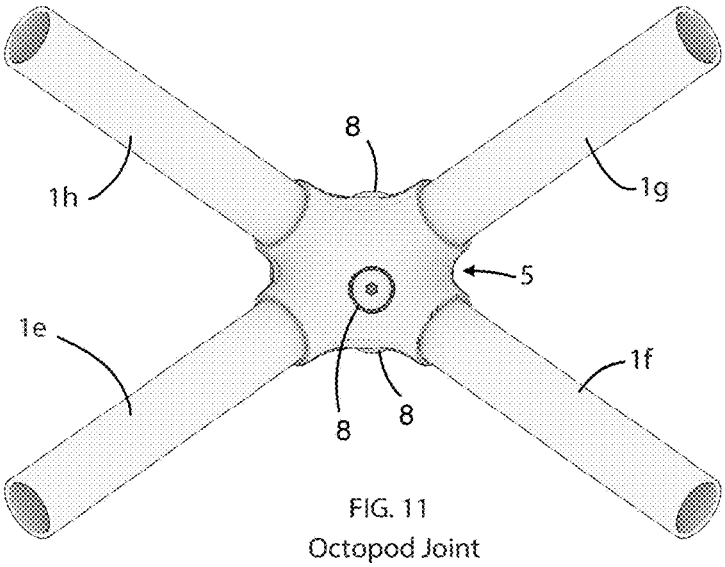
FIG. 11 is a top view of the octopod hub of FIG. 4.
Figure 12:
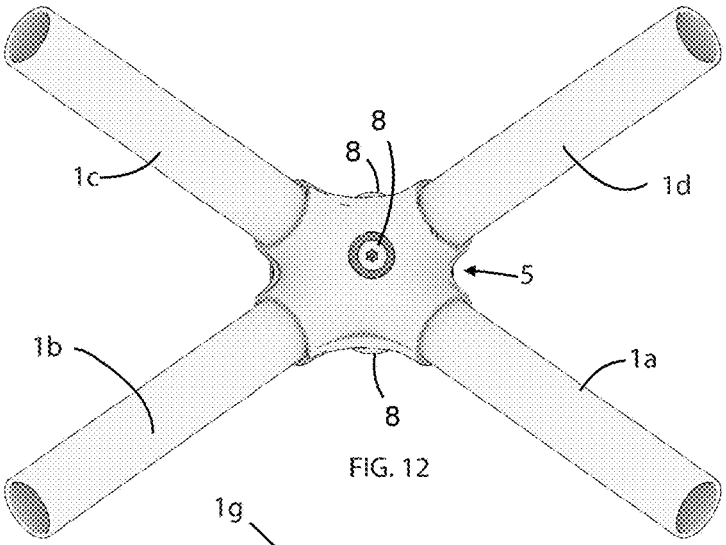
FIG. 12 is a bottom view of the octopod hub of FIG. 4.
Figure 13:
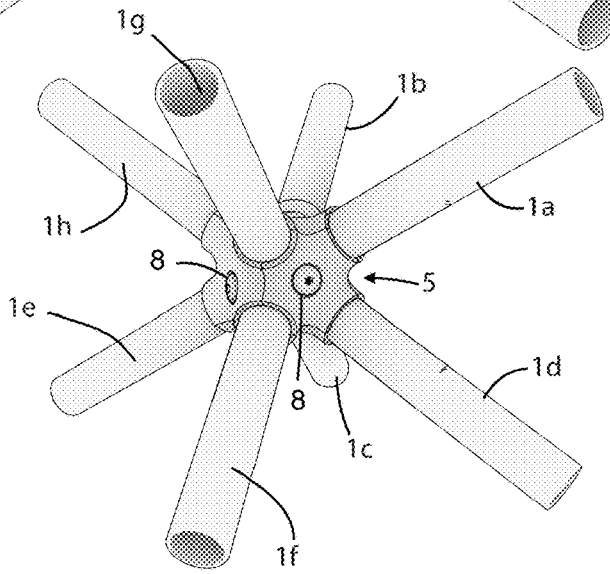
FIG. 13 is a perspective view of the octopod hub of FIG. 4.

FIGS. 11, 12, and 13 are top, bottom, and perspective views of an illustrative octopod hub 5 with eight tubes 1 extending therefrom. FIG. 11 is a top view showing four tubes 1*e*, 1*f*, 1*g*, and 1*h* of the eight tubes extending therefrom. FIG. 12 is a bottom view of the octopod hub 5 showing four tubes 1*a*, 1*b*, 1*c*, and 1*d* of the eight tubes extending therefrom. FIG. 13 is a perspective view of the octopod hub 5 showing all eight tubes 1*a*, 1*b*, 1*c*, 1*d*, 1*e*, 1*f*, 1*g*, and 1*h* extending therefrom. Octopod hubs 5 may be used to provide hubs common to three or four cuboctahedral frames, thus avoiding any duplication of material between cuboctahedral frames. The hub components of an octopod hub 5 may be manufactured as modular sections, thereby simplifying production.

Figure 14:
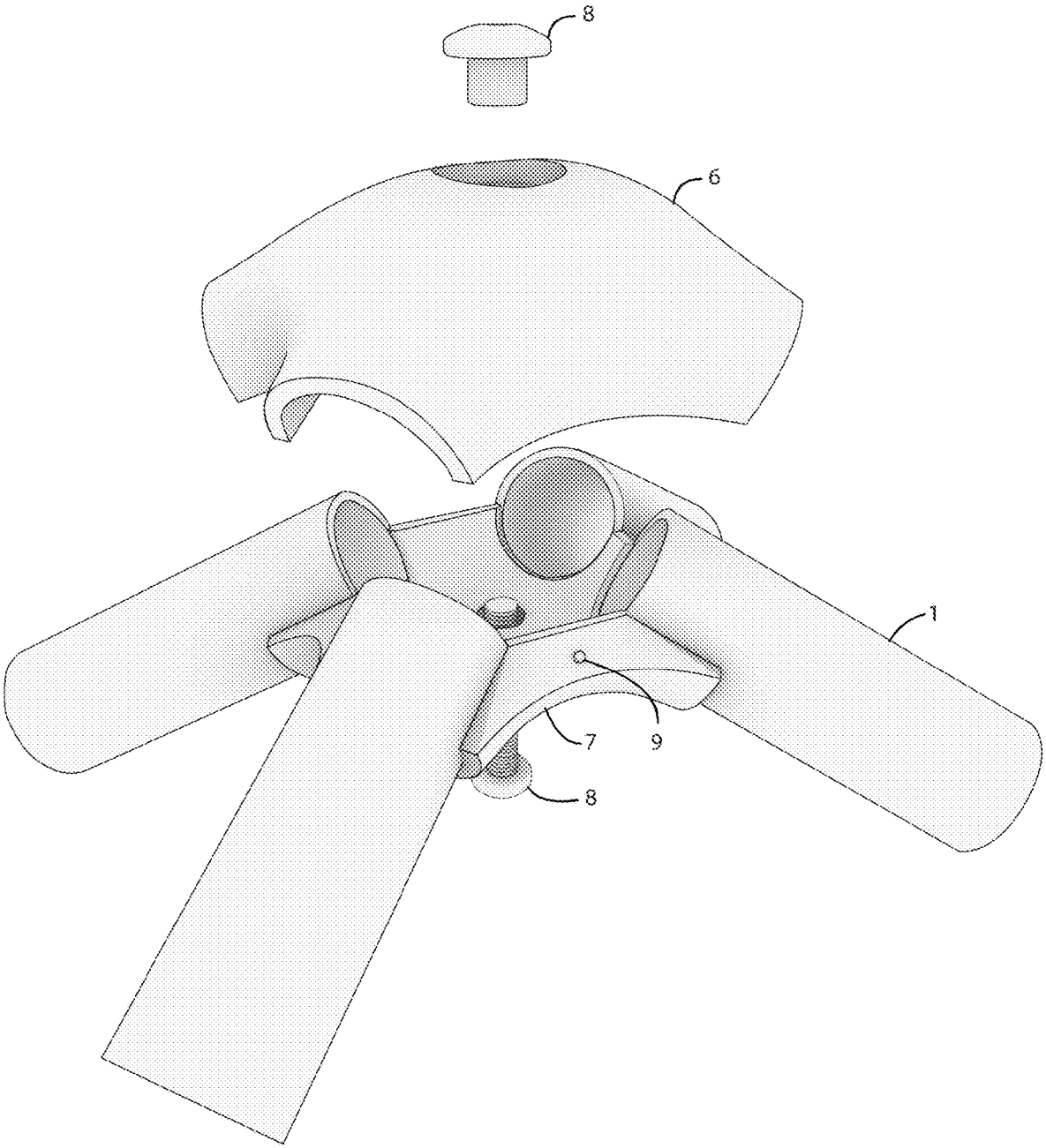
FIG. 14 is a partially exploded view of an illustrative tetrapod hub according to various embodiments of the invention.

FIG. 14 is a partially exploded perspective view of a tetrapod hub showing details of the mating hub component 6 and hub component 7, which comprise the tetrapod hub. FIG. 14 also shows an illustrative fastener 8 comprising an internally threaded cap and an externally threaded bolt, which may be used to draw the two hub components 6, 7 of the tetrapod hub toward each other, and thereby secure ends of the four tubes 1 between the tube receptacle portions of hub components 6, 7. Small depressions 9 in the bottom segment 7 may mate with matching protrusions in the top segment 6 to facilitate alignment of the hub components 6, 7 during assembly. The tubes may be secured within the tube receptacles of hub components 6, 7 by friction fit. The tube receptacles may be designed to have an inside diameter equal to or smaller than the outside diameter of the tubes, thereby providing for a transition fit or interference fit when the fasteners are tightened.

In the various hubs described in FIGS. 5-14, the angles between the tubes may be as follows. In the planes in which their respective longitudinal axes are coplanar, tube pairs 1*a* and 1*d*, 1*b* and 1*c*, 1*f* and 1*g*, 1*e* and 1*h*, 1*a* and 1*g*, 1*b* and 1*h*, 1*d* and 1*f*, and 1*c* and 1*e* may form 60 degree angles relative to each other. In the planes in which their respective longitudinal axes are coplanar, tube pairs 1*a* and 1*b*, 1*d* and *c*, 1*e* and 1*f*, and 1*g* and 1*h* may form 90 degree angles relative to each other. When twelve hubs and twenty-four tubes are assembled such that each tube is disposed between two hubs, with the ends of each tube residing in a tube receptacle of those hubs, these angles provide for the hubs and tubes to cooperate to form a cuboctahedral frame resembling a cuboctahedron.

Figure 15:
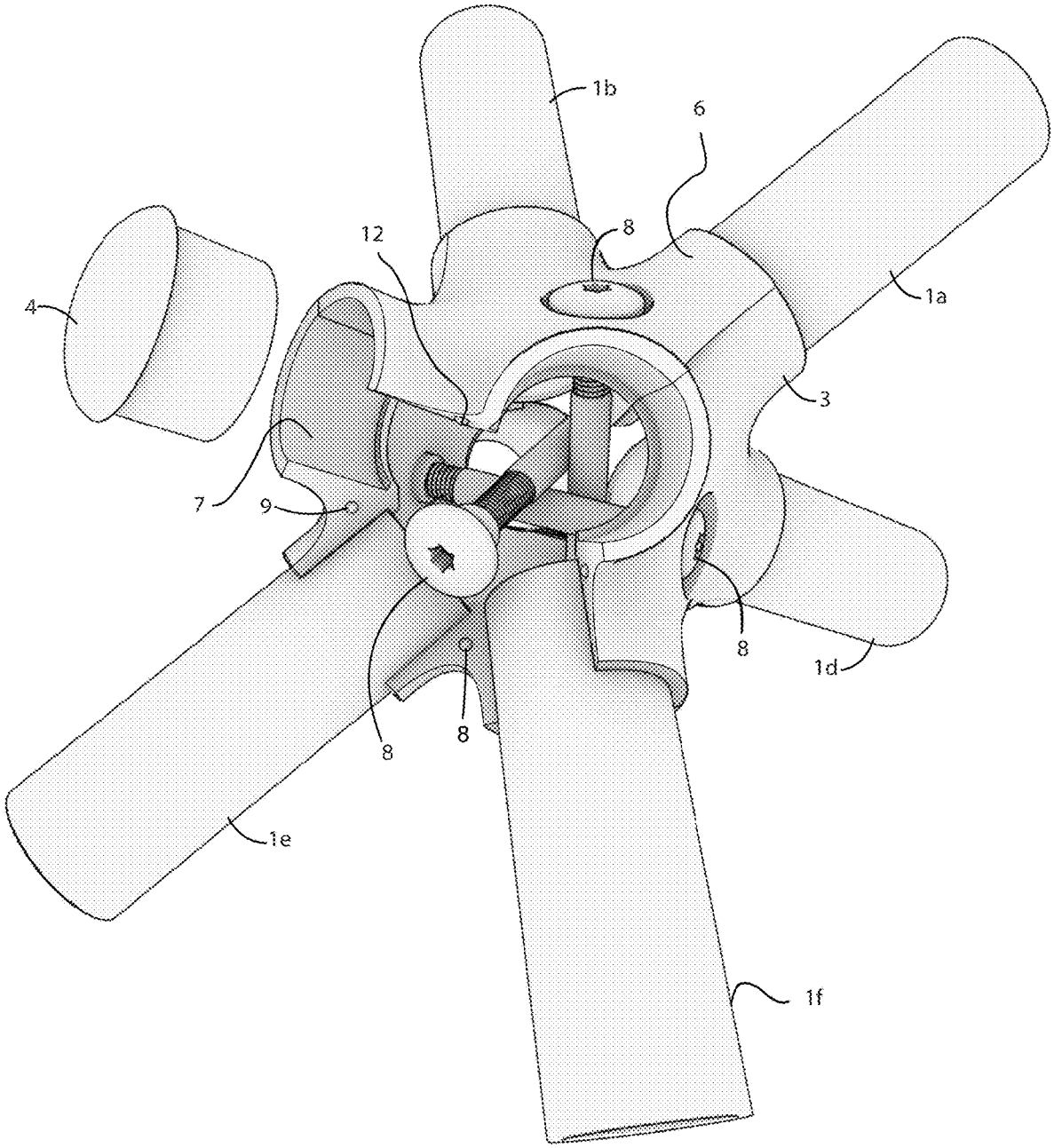
FIG. 15 is a partially exploded view of an illustrative hexapod hub and/or octopod hub according to various embodiments of the invention.

FIG. 15 shows an illustrative hexapod hub 3. Protrusions 12 of hub component 6 mate with depressions 9 of hub component 7 to facilitate their alignment relative to each other. The fasteners 8 may prevent movement and lock the hub components, for example hub components 6 and 7, securely in place.

Figure 16:
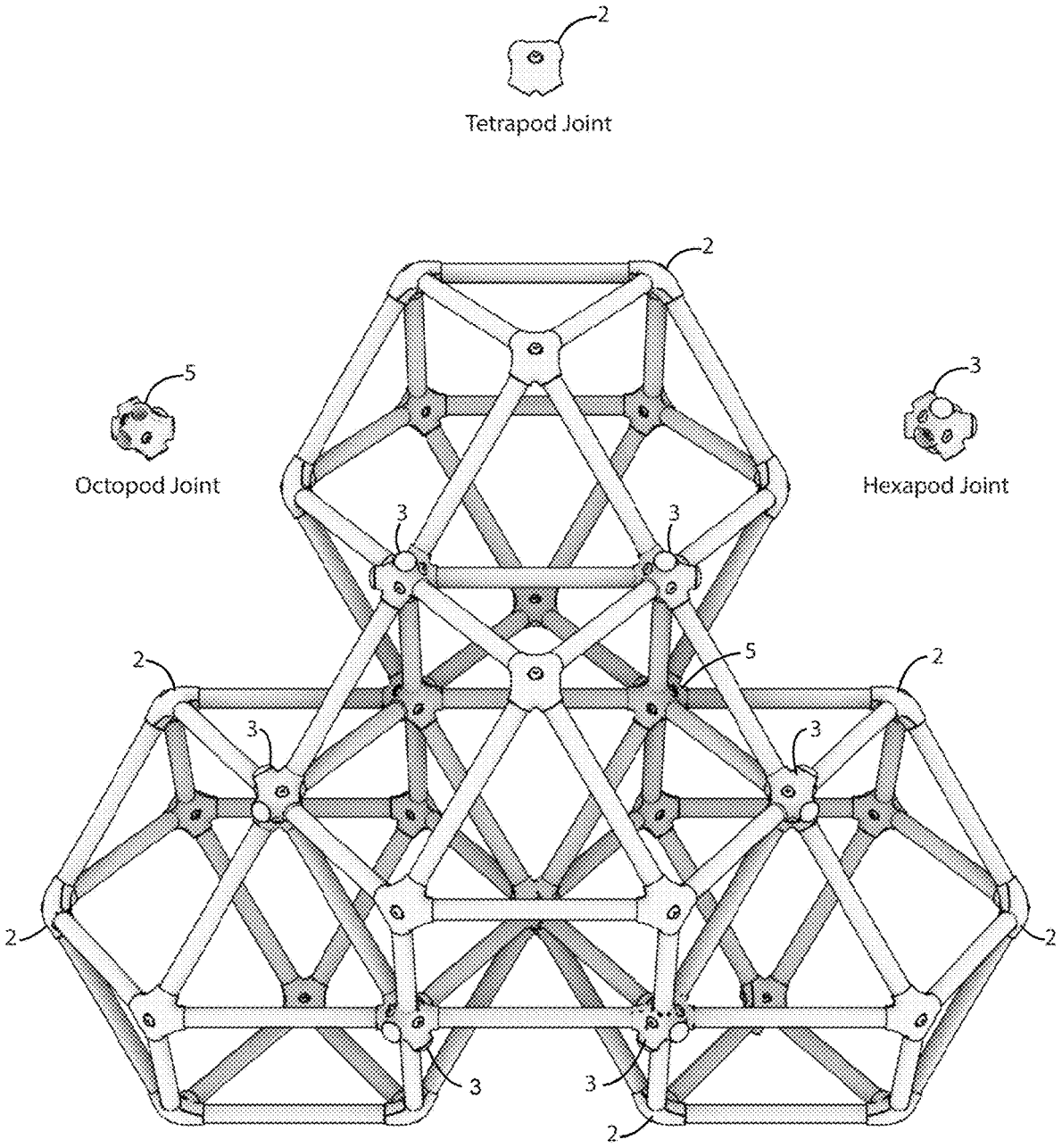
FIG. 16 is a perspective view of an illustrative cuboctahedron-based recreational structure comprising four joined cuboctahedral frames according to various embodiments of the invention.

FIG. 16 is a perspective view of a recreational structure comprising four joined cuboctahedral frames comprised of standard metal tubes joined entirely by the tetrapod hubs 2, hexapod hubs 3, and octopod hubs 5. Tetrapod hubs 2 occur at the unattached cuboctahedral frame corners, where a given hub (e.g., vertex) of a cuboctahedral frames is not shared with any other cuboctahedral frame. Hexapod hubs 3 are used where two cuboctahedral frames meet, where a given hub (e.g., vertex) is shared between two cuboctahedral frames. Octopod hubs 5 are used where any three or four cuboctahedral frames meet, where a given hub (e.g., vertex) is shared between three or four cuboctahedral frames. It is geometrically impossible for more than four cuboctahedral frames forms to meet at a single hub. The three described joining hubs-tetrapod hubs, hexapod hubs, and octopod hubs—are thus the only components needed to assemble standard metal tubes into a variety recreational structures comprising joined cuboctahedral frames. The tubes and hubs can be shipped in small containers, as opposed to the bulky containers required to ship existing structures. Moreover, in some embodiments of the invention, the tetrapod hubs, hexapod hubs, and octopod hubs may be formed from a total of four different hub components, two to form a tetrapod hub and two to form both a hexapod hub and an octopod hub. This may be accomplished because the hexapod hub and octopod hub may comprise the same two hub component pairs. Given that there may be only four different hub components required to manufacture a variety of recreational structures, manufacturing cost and complexity may be less than if greater component diversity was necessary.

In some embodiments, one or more stepping platforms 10 may be attached to tubes of an assembled recreational structure (e.g., in a "space" of a cuboctahedral frame) in order to provide horizontal surfaces on which an individual may stand or sit inside the recreational structure, and to assist with climbing between or over portions of a recreational structure. FIG. 17 shows the illustrative recreational structure of FIG. 16 (comprising four joined cuboctahedral frames) with five illustrative stepping platforms 10 attached thereto. In other embodiments, different numbers and/or arrangements of assembled cuboctahedral frames and/or stepping platforms 10 may be used. The platforms 10 may be steel panels, or another sturdy, weather-resistant material. The platforms 10 may be perforated, partially perforated, or solid. Although the panels 10 may have a smooth surface, a textured surface may be preferred to improve safety and provide a more rigid panel 10 than might otherwise be the case. FIG. 17 shows an embodiment of the platforms 10 in which sides of each stepping platform 10 are shaped to match the shape of the tube 1, thereby fit over and partially cover a tube 1 that forms a portion of a cuboctahedral frame, and thereby assist with holding the platforms 10 in place.

Holes 11 may also be provided along sides of a stepping platform 10 so that the platform can be secured in place with a fastener (e.g., a bolt, pin, rivet, clamp, or other fastener) to the tubes 1. In other embodiments, however, different mechanisms may be used to secure platform 10 in place. For example, in some embodiments, platform 10 may be secured to one or more tubes of an assembled recreational structure solely by friction fit. For example, platform 10 may be designed with edges curled to have an inside diameter equal to or slightly smaller than the outside diameter of the tubes, thereby providing for a transition fit or interference fit when assembled to the tubes.

While there have been shown and described fundamental novel features of the invention as applied to preferred and illustrative embodiments thereof, it will be understood that omissions, substitutions, and changes in the form and details of the disclosed invention may be made by those skilled in the art without departing from the invention.

Moreover, as is readily apparent, numerous modifications and changes may readily occur to those skilled in the art. For example, various features and structures of the different embodiments discussed herein may be combined and interchanged. Hence, it is not desired to limit the invention to the exact construction and operation shown and described herein and, accordingly, all suitable modification equivalents may be resorted to falling within the scope of the invention as claimed. It is the intention, therefore, to be limited only as indicated by the scope of the claims appended hereto.

The steps of the method described in the various embodiments and examples disclosed herein are sufficient to carry out the methods of the present invention. Thus, in an embodiment, the method consists essentially of a combination of the steps of the methods disclosed herein. In another embodiment, the method consists of such steps.

Now that features of the invention and some embodiments of the invention have been described, an outline (non-limiting) of various embodiments of the invention is stated as follows:

A1. A kit for assembling one or more modular cuboctahedron-based recreational structures, the kit comprising:

- a plurality of hubs, each hub configured to receive a plurality of tubes extending from different ones of the plurality of hubs to form one or more cuboctahedral frames, said plurality of hubs including:
  - a tetrapod hub having four tube receptacles, the tetrapod hub being configured to form a vertex of one of the cuboctahedral frames; and/or
  - a hexapod hub having six tube receptacles, the hexapod hub being configured to form a vertex of up to two cuboctahedral frames; and/or
  - an octopod hub having eight tube receptacles, the octopod hub being configured to form a vertex of up to four cuboctahedral frames;
- wherein each tube receptacle is configured to mate with one of the tubes, and each tube is configured to mate with a tube receptacle of another hub of the plurality of hubs.

A2. The kit of Statement A1, wherein each tube receptacle comprises a first mating surface configured to mate with a second mating surface of one of the tubes, wherein the first mating surface and second mating surface are configured to maintain the relative positions of the tube and the tube receptacle.

A3. The kit of Statement A2, wherein one of the first and second mating surfaces has a depression and the other of the first and second mating surfaces has a protrusion, wherein the protrusion is complementary to the depression.

A4. The kit of any of Statements A1 to A3, wherein each hub comprises a plurality of hub components.

A5. The kit of Statement A4, further comprising a fastener configured to fasten two or more of the hub components to each other.

A6. The kit of any of Statements A1 to A5, wherein each hub is aluminum, steel, plastic, or carbon fiber composite.

A7. The kit of any of Statements A1 to A6, wherein at least one of the hubs has a rounded apex. A8. The kit of any of Statements A1 to A7, further including a stepping platform configured to be attached to two or more tubes of the plurality of tubes.

A9. The recreational structure of any of Statements A1 to A8, wherein the hexapod hub has eight tube receptacles, wherein six of the tube receptacles are configured to receive one of the tubes and two of the eight tube receptacles are configured to receive a plug.

A10. A climbable recreational structure comprising one or more cuboctahedral frame assemblies, each cuboctahedral frame assembly including six square spaces, eight triangular spaces, and twelve vertices, wherein the structure is assembled from a plurality of hubs comprising tetrapod hubs connecting four tubes, hexapod hubs connecting six tubes, and/or octopod hubs connecting eight tubes.

A11. The structure of Statement A10, further including a stepping platform configured to be attached to two or more tubes of an assembled cuboctahedral frame.

A12. A recreational structure, comprising:

a plurality of hubs, each hub comprising a plurality of tube receptacles; and a plurality of tubes;

wherein the plurality of hubs and the plurality of tubes are arranged to form one or more cuboctahedral frames, each cuboctahedral frame having twelve vertices and twenty-four edges, wherein the edges of the one or more cuboctahedral frames each comprise one of the plurality of tubes, wherein the vertices of the one or more cuboctahedral frames comprise one of the plurality of hubs, and wherein connections between the hubs and the tubes are formed by an end portion of each tube disposed within a tube receptacle of a hub A13. The recreational structure of Statement A12, wherein the plurality of hubs includes one or more of:

a tetrapod hub having four tube receptacles, the tetrapod hub being configured to receive one of the tubes, the tetrapod hub configured to form a vertex of one of the cuboctahedral frames; and/or a hexapod hub having six tube receptacles, the hexapod hub being configured to receive one of the tubes, the hexapod hub configured to form a vertex of one or more of the cuboctahedral frames; and/or an octopod hub having eight tube receptacles, the octopod hub being configured to receive one of the tubes, the octopod hub configured to form a vertex of one or more of the cuboctahedral frames.

A14. The recreational structure of Statement A13, wherein at least one of the hubs has a rounded apex.

A15. The recreational structure of any of Statements A12 to A14, wherein each hub comprises a plurality of hub components.

A16. The recreational structure of Statement A15, further comprising a fastener configured to fasten two or more of the hub components to each other.

A17. The recreational structure of any of Statements A15 or A16, wherein each hub component includes:

a depression configured to receive a protrusion of another hub component; or a protrusion configured to fit into a depression of another hub component.

A18. The recreational structure of any of Statements A12 to A17, wherein the hubs comprise aluminum, steel, plastic, or carbon fiber composite.

A19. The recreational structure of any of Statements A12 to A18, further including a stepping platform attached to two or more tubes of the plurality of tubes.

A20. The recreational structure of any of Statements A12 to A19, wherein the tubes comprise metal, plastic, composite material, or carbon fiber.

A21. The recreational structure of any of Statements A12 to A20, wherein the hexapod hub has eight tube receptacles, wherein six of the tube receptacles are configured to receive one of the tubes and two of the eight tube receptacles are configured to receive a plug.

Although the present disclosure has been described with respect to one or more particular embodiments, it will be understood that other embodiments of the present disclosure may be made without departing from the scope of the present disclosure.

What is claimed is:

1. A kit for assembling one or more modular cuboctahedron-based recreational structures, the kit comprising:

a plurality of tubes, each tube having a first end and a second end;

a plurality of hubs, wherein (a) each of the hubs has at least two matable components, each matable component having a through hole for accommodating a fastener that holds the matable components together, and (b) the matable components are shaped so that when the matable components are held together by the fastener, each hub has at least four tube receptacles, each receptacle being configured to receive one of the ends of one of the tubes, and (c) the tube ends are sized so that when the one or more modular cuboctahedron-based recreational structures are assembled, each tube end is held within a different one of the tube receptacles;

(d) each tube has a length so that when the one or more modular cuboctahedron-based recreational structures are assembled, each tube that extends from a particular one of the hubs extends to a different hub where the tube is received in a receptacle of that different hub, said plurality of hubs including:

(i) a tetrapod hub having only four tube receptacles, the tetrapod hub being configured to form a vertex of one of the cuboctahedral frames; and/or (ii) a hexapod hub having six tube receptacles, the hexapod hub being configured to form a vertex of up to two cuboctahedral frames; and/or (iii) an octopod hub having only eight tube receptacles, the octopod hub being configured to form a vertex of up to four cuboctahedral frames.

2. The kit of claim 1, wherein each tube receptacle comprises a first mating surface configured to mate with a second mating surface of one of the tubes, wherein the first mating surface and second mating surface are configured to maintain the relative positions of the tube and the tube receptacle.

3. The kit of claim 2, wherein one of the first and second mating surfaces has a depression and the other of the first and second mating surfaces has a protrusion, wherein the protrusion is complementary to the depression.

4. The kit of claim 1, wherein each hub is aluminum, steel, plastic, or carbon fiber composite.

5. The kit of claim 1, wherein at least one of the hubs has a rounded apex.

6. The kit of claim 1, further including a stepping platform configured to be attached to two or more tubes of the plurality of tubes.

7. The kit of claim 1, wherein the hexapod hub has eight tube receptacles, wherein six of the tube receptacles are configured to receive one of the tubes and two of the eight tube receptacles are configured to receive a plug.

8. A climbable recreational structure comprising one or more cuboctahedral frame assemblies, the frame assemblies being comprised of a plurality of tubes and a plurality of hubs arranged to provide six substantially square spaces, eight substantially triangular spaces, and twelve vertices, wherein the plurality of hubs comprise tetrapod hubs connecting to exactly four of the tubes, and/or hexapod hubs connecting to exactly six of the tubes, and/or octopod hubs connecting to exactly eight of the tubes, and wherein each of the hubs comprises at least two mating components each component having a hole for accommodating a fastener that holds the mating components together.

9. The recreational structure of claim 8, further including a stepping platform configured to be attached to two or more tubes of an assembled cuboctahedral frame.

10. The recreational structure of claim 8, further comprising one fastener for each tetrapod hub, wherein each of the fasteners holds one of the mating components to another of the mating components.

11. The recreational structure of claim 8, further comprising three fasteners for each hexapod hub, wherein each of the fasteners holds one of the mating components to another of the mating components.

12. The recreational structure of claim 8, further comprising three fasteners for each octopod hub, and wherein each of the fasteners holds one of the mating components to another of the mating components.

13. A recreational structure, comprising:

a plurality of hubs, each of the hubs;

has at least two mating components each component having a hole for accommodating a fastener;

has a fastener extending through the holes and holding the mating components together; and provides a plurality of tube receptacles; and a plurality of tubes;

wherein the plurality of hubs and the plurality of tubes are arranged to form one or more cuboctahedral frames, each cuboctahedral frame has twelve vertices and twenty-four edges, each of the edges of the one or more cuboctahedral frames comprises one of the plurality of tubes, each of the vertices of the one or more cuboctahedral frames comprises one of the hubs, and connections between the hubs and the tubes are each formed by an end portion of one of the tubes disposed within one of the tube receptacles of one of the hubs; and the hubs comprise;

a tetrapod hub having four tube receptacles, the tetrapod hub receiving exactly four of the tubes, the tetrapod hub configured to form a vertex of one of the cuboctahedral frames; and/or a hexapod hub having six tube receptacles, the hexapod hub receiving exactly six of the tubes, the hexapod hub configured to form a vertex of one or more of the cuboctahedral frames; and/or an octopod hub having eight tube receptacles, the octopod hub receiving exactly eight of the tubes, the octopod hub configured to form a vertex of one or more of the cuboctahedral frames.

14. The recreational structure of claim 13, wherein at least one of the hubs has a rounded apex.

15. The recreational structure of claim 13, wherein each hub component includes:

a depression configured to receive a protrusion of another hub component; or a protrusion configured to fit into a depression of another hub component.

16. The recreational structure of claim 13, wherein the hubs comprise aluminum, steel, plastic, or carbon fiber composite.

17. The recreational structure of claim 13, further including a stepping platform attached to two or more tubes of the plurality of tubes.

18. The recreational structure of claim 13, wherein the tubes comprise metal, plastic, composite material, or carbon fiber.

19. The recreational structure of claim 13, wherein the hexapod hub has eight tube receptacles, wherein six of the tube receptacles are configured to receive one of the tubes and two of the eight tube receptacles are configured to receive a plug.

20. The recreational structure of claim 13, further comprising one fastener for each tetrapod hub, wherein each of the fasteners holds one of the mating components to another of the mating components.

21. The recreational structure of claim 13, further comprising three fasteners for each hexapod hub, wherein each of the fasteners holds one of the mating components to another of the mating components.

22. The recreational structure of claim 13, further comprising three fasteners for each octopod hub, and wherein each of the fasteners holds one of the mating components to another of the mating components.

* * * * *